US006044497A

United States Patent [19]

Richardson

[11] Patent Number: 6,044,497

[45] Date of Patent: Apr. 4, 2000

[54] HALF SOCK

[75] Inventor: Heath Richardson, Orange Park, Fla.

[73] Assignee: Toasty Toes, L.L.C., Orange Park, Fla.

[21] Appl. No.: 09/135,115

[22] Filed: Aug. 17, 1998

[51] Int. Cl.[7] ..... A41B 11/00

[52] U.S. Cl. ..... 2/239; 2/61; 36/7.4; 36/77 R

[58] Field of Search ..... 2/239, 241, 22, 2/61; 36/7.2, 7.4, 77 R, 72 R

[56] References Cited

U.S. PATENT DOCUMENTS

| | | | |
|---|---|---|---|
| 246,454 | 8/1881 | Bruen . | |
| 1,724,784 | 8/1929 | Teichmann | 36/4 |
| 1,726,441 | 8/1929 | Loven | 2/239 |
| 1,889,716 | 11/1932 | Walker | 2/61 |
| 2,061,160 | 11/1936 | Kendall | 36/72 |
| 2,314,359 | 3/1943 | Masterson | 36/10 |
| 2,391,064 | 12/1945 | McCandless | 2/239 |
| 2,412,087 | 12/1946 | Herbert | 2/239 |
| 2,674,740 | 4/1954 | Kidd | 2/61 |
| 2,810,214 | 10/1957 | Wolfe | 36/8.3 |
| 3,334,356 | 8/1967 | Abel | 2/239 |
| 3,887,946 | 6/1975 | Laskin et al. | 2/239 |
| 3,925,916 | 12/1975 | Garbuio | 36/71 |
| 4,145,822 | 3/1979 | Mitchell et al. | 36/87 |
| 4,294,022 | 10/1981 | Stockli et al. | 36/4 |
| 4,372,057 | 2/1983 | Nielsen | 36/10 |
| 4,723,364 | 2/1988 | Marxer | 36/10 |
| 4,736,531 | 4/1988 | Richard | 36/114 |
| 4,809,447 | 3/1989 | Pacanowsky et al. | 36/9 R |
| 5,084,986 | 2/1992 | Usui | 36/2.6 |
| 5,152,086 | 10/1992 | Bonaventure | 36/117 |
| 5,174,050 | 12/1992 | Gabrielli | 36/117 |
| 5,471,767 | 12/1995 | Walker | 36/2.6 |
| 5,575,015 | 11/1996 | Paris et al. | 2/240 |
| 5,623,734 | 4/1997 | Pugliatti | 2/239 |
| 5,815,948 | 10/1998 | Dzielak | 2/22 |

OTHER PUBLICATIONS

Pick et al. (Eds.), *Gray's Anatomy*, 15th Edition, 1995, Barnes & Noble, Inc., pp. 393 & 402.

U.S. Patent Application Ser. No. 29/093580, Richardson.

*Primary Examiner*—Diana Oleksa
*Assistant Examiner*—Katherine Moran
*Attorney, Agent, or Firm*—Christopher John Rudy

[57] ABSTRACT

Half sock, in general, can cover the anterior limb of a foot, leaving the heel bare. The half sock includes a sock housing with a rear opening for insertion of the foot therein. It is made of a suitably cushioning, durable, flexible, thermally-insulating and physically-proportioned material, for one illustration, a neoprene-containing material, for example, an about 3-mm neoprene material having a flexible nylon lining on either side thereof. The half sock can have, in essence, mirror image symmetry through an imaginary plane bisecting its top and bottom portions. It can include inwardly-directed front tapers to accommodate the big and the smaller toes of the foot, and include inwardly-directed rear tapers to accommodate the arch of the foot. It can be made of a one-piece web in a clamshell like pattern, having side edges butted and sewn together so that there is little or no bump. The half sock can be employed for keeping warm toes during a cold weather activity, especially to include when wearing boots such as hunting, military or, in particular, ski boots.

20 Claims, 2 Drawing Sheets

HALF SOCK

FIELD

The present invention concerns an article of apparel for the foot, which is a sock-like article which, in general, covers the anterior limb of the foot, leaving the heel bare, and its making and using. The invention is useful in snow skiing, snow boarding and other winter activities, providing for warmth and comfort to the foot and toes, and for other advantages and benefits.

BACKGROUND

A problem common to snow skiers and snow boarders is that of cold feet, particularly cold toes. Being a winter activity, a participant in such a sport not only must consider his athletic conditioning but also must contend with his equipment and the winter elements. The problem can be compounded when the participant obtains rental boots, as many do, which are often stretched, and worn or torn inside, and sparse in if not devoid of effective or comfortable padding, especially about the toes.

In addressing the problem, the participant may resort to heavy socks. However, despite known, expensive, heavy ski socks, the problem of cold feet remains to plague the winter sports participant.

It would be desirable to ameliorate if not overcome this problem, emblematic of a lack and long-felt need in the art. It would be especially desirable if the same were to be provided by simple yet effective ways and means, which provide further advantages and benefits.

SUMMARY

The present invention provides, in one aspect, an article of apparel comprising a half sock which, in general, covers the anterior limb of the foot, leaving the heel bare, said half sock made of a suitably cushioning, durable, flexible, thermally-insulating and physically-proportioned material. In other aspects, methods of making and using the half sock are provided.

The invention is useful in snow skiing, snow boarding and other winter activities, providing for warmth and comfort to the foot and toes. Other advantages and benefits are extant as well.

The main problem ameliorated or overcome by the invention is the provision of a product, the half sock, which can keep a person's toes warm while he participates in a winter activity. The material employed in the present invention creates an environment which traps in heat. The product is also designed with a material which is flexible and therefore conforms to the shape of the person's foot when being worn, which, in general, insures that the product will not slip off during use.

Specific applications of the half sock product include its use with rental ski boots. As previously mentioned, these boots are sometimes stretched out, and the padding is worn. The invention allows for a more snug fit while providing warmth more effectively than previously available, especially with worn or torn boot linings. This will allow the ski boot rental industry more longevity per pair of rental boots and significantly improve the quality of service and profitability. Other applications include use with hunting boots, military boots, and so forth.

The product also provides a level of instep support which has a positive impact on fallen arches, flat feet and various other foot maladies.

The half sock can be manufactured efficiently.

Numerous further advantages attend the invention.

DRAWINGS

The drawings form part of the specification hereof. With respect to the drawings, the following is briefly noted:

ILLUSTRATIVE DETAIL

The invention can be further understood by consideration of the following detail, which may be read in view of the drawings. The same should be taken in an illustrative and not necessarily limiting sense.

Figure 1:
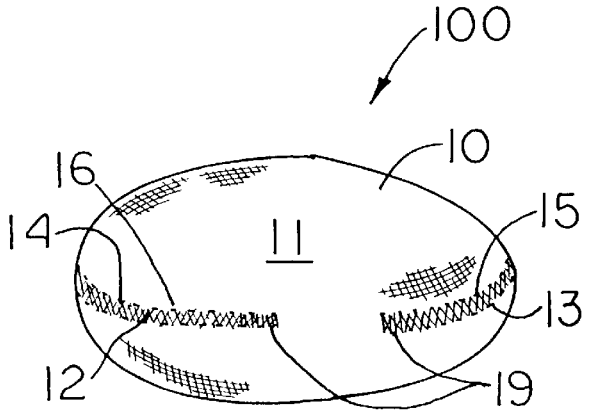
FIG. 1 is a front perpsective view of a half sock of the present invention.
Figure 2:
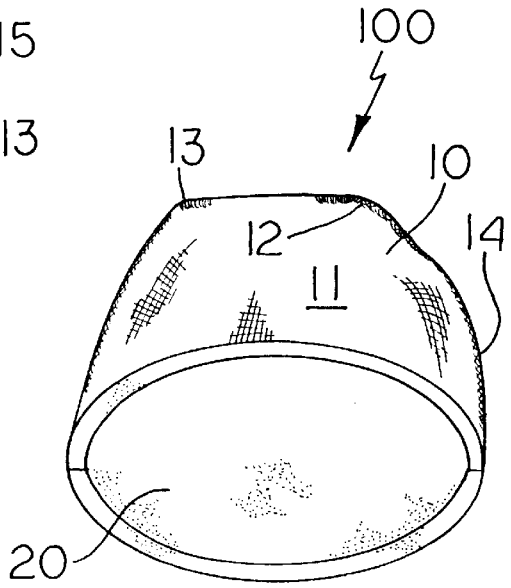
FIG. 2 is a rear perspective view of the half sock of FIG. 1.
Figure 3:
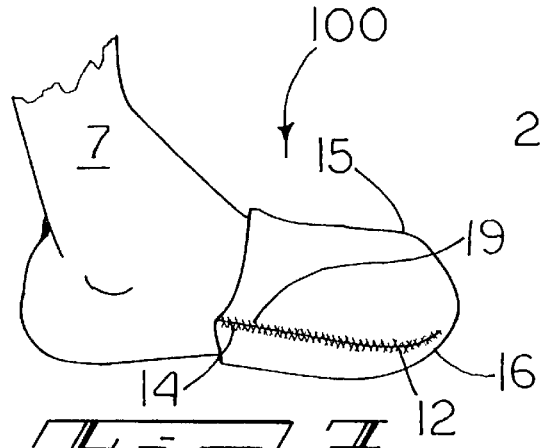
FIG. 3 is a side perspective view of the half sock of FIGS. 1 & 2, being worn on the foot.
Figure 4:
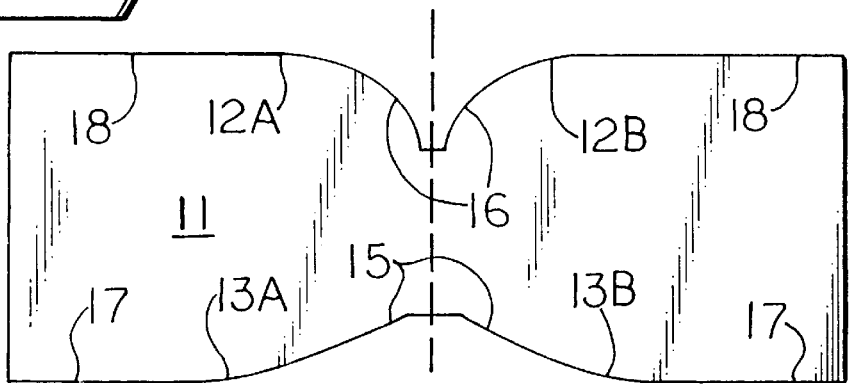
FIG. 4 is a plan view of a sewing pattern for providing cut out material for making the half sock of FIGS. 1–3.

In reference to the drawings, half sock 100 includes sock housing 10 with rear opening 20 for insertion of foot 7 therein. The housing 10 includes suitably cushioning, durable, flexible, thermally-insulating and physically-proportioned material web 11, which may be provided from a one-piece, symmetrical, clamshell like, sewing pattern (FIG. 4) having side edges 12 & 13 sewn together along seam 14. Preferably the one-piece, clamshell like material web 11 is of substantial thickness and is sewn together with corresponding side edges 12*a* & 12*b*, and 13*a* & 13*b*, pressed up against each other in a butting relationship rather than in an overlapping relationship so that there is virtually no built-up or "bumpy" seam. This makes the half sock 100 as a half sock like covering for the foot which, in general, covers the anterior limb of the foot 7, leaving the heel bare, or, in other words, which extends to the back of the arch and covers the top of the foot (FIG. 3). The pattern (FIG. 4) resembles the shape of the anterior limb of the foot 7 in that it has inwardly-directed front tapers to accommodate the big toe 15 and smaller toes 16, and it also has inwardly-directed rear tapers 17 & 18 to accommodate the arch of the foot 7 so as to better support the foot 7 and generally insure a comfortable fit. The half sock 100 thus constructed can have top to bottom symmetry, and so, one unit can be worn on either the right or on the left foot. And so, in essence, the half-sock 100 can have mirror image symmetry through an imaginary plane bisecting its top and bottom portions.

In the practice of the invention, the half sock 100 may be made with the web 11 an about 1-mm to 5-mm thick foamed, rubbery type material, for example, an about 3-mm thick foamed neoprene material center, sandwiched with a stretchable lining such as of nylon or polypropylene, for example, of nylon, on each side thereof. The material can be cut to form the one-piece web 11 (FIG. 4) and sewn with suitable thread 19 such as of nylon or polyester on both of the edges 12 & 13. Other materials from which the web 11 may be made may include THINSULATE (3M) material or any other suitable cushiony, thermally insulating material.

As an alternative, the half sock of the invention may be made of a suitable moldable material, in one piece, without seams. In such a case, a suitable foamable plastic may be employed. For instance, the moldable foamable plastic may perhaps include the neoprene and/or THINSULATE material(s) and so forth and the like.

The half sock of the invention can be worn as a pair by themselves or, preferably, in conjunction with a pair of full socks. Typically, the half sock is worn directly on the foot with the full sock covering the half sock and the remainder of the foot not covered by the half sock.

The half sock of the invention has been field tested during winter activity. Individuals who tried them while snow skiing or snow boarding found that their toes were kept warmer wearing the half socks than if they were to wear full socks alone in their boots. Use of the half sock of the invention during downhill skiing activity, in particular, is highly advantageous.

CONCLUSION

The present invention is thus provided. Numerous modifications can be effected within its spirit, the literal claim scope of which is particularly pointed out as follows:

I claim:

1. An article of apparel comprising a half sock which, in general, can cover the anterior limb of a foot, leaving the heel bare, said half sock including a sock housing with a rear opening for insertion of the foot therein, and a front part; and being made of a suitably cushioning, durable, flexible, thermally-insulating and physically-proportioned material, wherein:

the half sock has, in essence, mirror image symmetry through an imaginary plane bisecting ton and bottom portions thereof;

said sock housing includes inwardly-directed front tapers to accommodate big and smaller toes of the foot, and inwardly-directed rear tapers to accommodate an arch of the foot, with at least two of the set of said tapers being of a shape and size different from each other, wherein said tapers are present even when the article is not worn on the foot by a user, and said sock housing is made of a one-piece web in a clamshell like pattern, having upper and lower portions to the one-piece web which are interconnected through the front part of said housing, and two side portions taken from edges of the upper and lower portions to the one-piece web which are butted and sewn together to form two opposing side seams in which there is little or no bump.

2. The article of claim 1, wherein the sock housing is made of a neoprene material having a thickness of about 3 mm and further thereto having a flexible nylon lining on either side thereof.

3. The article of claim 1, wherein the sock housing includes being made with a neoprene-containing material.

4. The article of claim 3, wherein the neoprene-containing material is about 1 mm to 5 mm thick.

5. The article of claim 1, wherein the sock housing includes being made with a foamed, rubbery type material.

6. The article of claim 5, wherein the foamed, rubbery type material is about 1 mm to 5 mm thick.

7. A method of keeping toes warm during a cold weather activity of snow skiing or snow boarding, which method comprises:

A) providing a half sock which, in general, can cover the anterior limb of a foot, leaving the heel bare, said half sock including a sock housing with a rear opening for insertion of the foot therein, and being made of a suitably cushioning, durable, flexible, thermally-insulating and physically-proportioned material, wherein the half sock contains features selected from the group consisting of:

having, in essence, mirror image symmetry through an imaginary plane bisecting top and bottom portions thereof, plus including inwardly-directed front tapers to accommodate big and smaller toes of the foot, and inwardly-directed rear tapers to accommodate an arch of the foot, with at least two of the set of said tapers being of a shape and size different from each other, wherein said tapers are present even when the article is not worn on the foot by a user; and having said material being a neoprene-containing material;

B) placing the half sock over the anterior limb of the foot;

C) inserting the foot covered by the half sock into at least two other foot coverings, which include a standard sock and a ski boot; and D) wearing the half sock and the at least one other foot covering in the cold weather during the snow skiing or snow boarding such that the toes are kept warm thereby when otherwise the toes would not be kept so warm.

8. The method of claim 7, wherein said sock housing includes, in essence, the mirror image symmetry through the imaginary plane bisecting top and bottom portions thereof, plus including the inwardly-directed front tapers to accommodate the big and smaller toes of the foot, and the inwardly-directed rear tapers to accommodate the arch of the foot, with at least two of the set of said tapers being of a shape and size different from each other.

9. The method of claim 8, wherein the half sock is made of the neoprene-containing material.

10. The method of claim 9, wherein the activity is downhill skiing or snowboarding.

11. The method of claim 10, wherein the ski boots are rental ski boots, and longevity per pair of the rental ski boots is increased through use of the half sock.

12. The method of claim 8, wherein the activity is downhill skiing or snowboarding.

13. The method of claim 12, wherein the ski boots are rental ski boots, and longevity per pair of the rental ski boots is increased through use of the half sock.

14. The method of claim 7, wherein the half sock is made of the neoprene-containing material.

15. The method of claim 14, wherein the activity is downhill skiing or snowboarding.

16. The method of claim 15, wherein the ski boots are rental ski boots, and longevity per pair of the rental ski boots is increased through use of the half sock.

17. The method of claim 7, wherein the activity is downhill skiing or snowboarding.

18. The method of claim 17, wherein the ski boots are rental ski boots, and longevity per pair of the rental ski boots is increased through use of the half sock.

19. An article of apparel comprising a half sock which, in general, can cover the anterior limb of a foot, leaving the heel bare, said half sock including a sock housing with a rear opening for insertion of the foot therein, and a front part; and being made of a suitably cushioning, durable, flexible, thermally-insulating, physically-proportioned, foamable, moldable, plastic material, wherein:

the half sock has, in essence, mirror image symmetry through an imaginary plane bisecting top and bottom portions thereof;

said sock housing includes inwardly-directed front tapers to accommodate big and smaller toes of the foot, and inwardly-directed rear tapers to accommodate an arch of the foot, with at least two of the set of said tapers being of a shape and size different from each other, wherein said tapers are present even when the article is not worn on the foot by a user, and said sock housing is made of one piece, without seams.

20. The article of claim 19, wherein said plastic material includes neoprene.

* * * * *

UNITED STATES PATENT AND TRADEMARK OFFICE

CERTIFICATE OF CORRECTION

PATENT NO. : 6,044,497
DATED : April 4, 2000
INVENTOR(S) : Heath Richardson

It is certified that error appears in the above-identified patent and that said Letters Patent is hereby corrected as shown below:

Drawings,
Sheet 1 of 2, should be deleted to be replaced with drawing sheet 1 of 2, as shown on the attached page.

Figure 5:
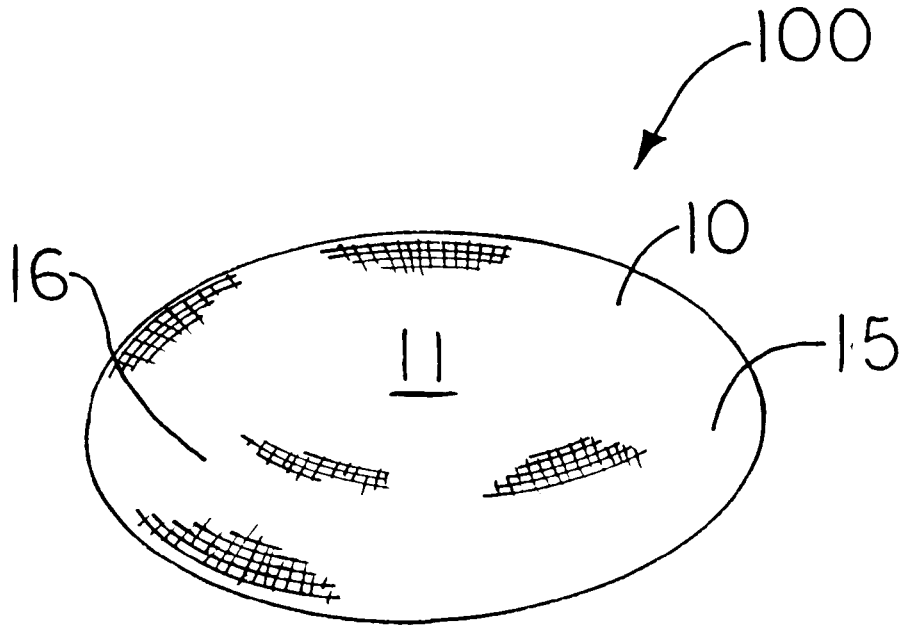
FIG. 5 is a view of a seamless half sock.
Figure 6:
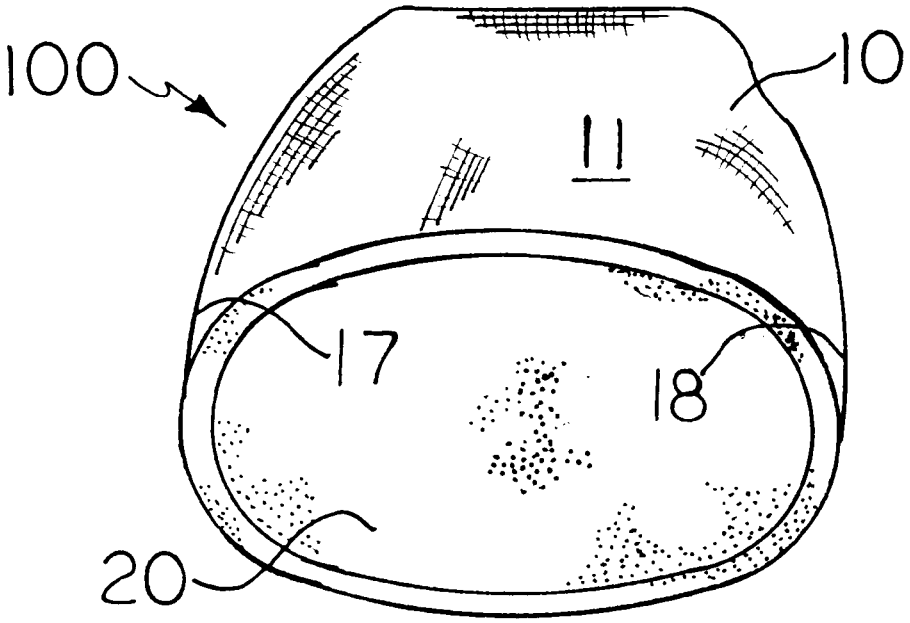
FIG. 6 is a view of the half sock of FIG. 2 depicting the set of rear tapers.
Figure 1:
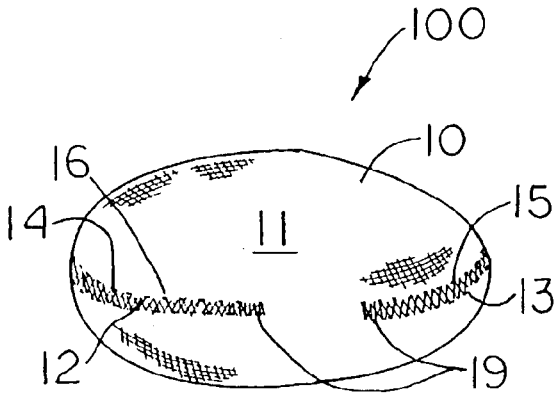
Figure 2:
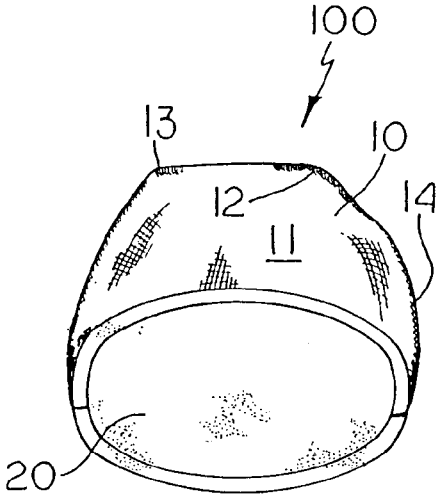
Figure 3:
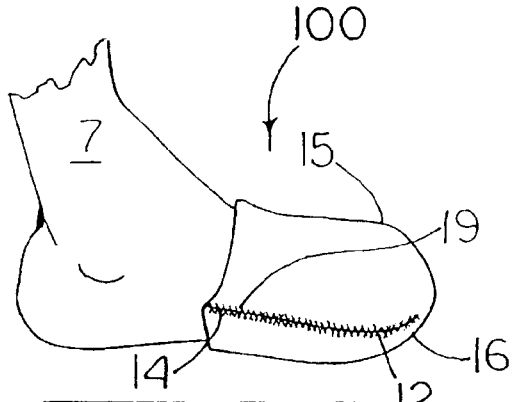
Figure 4:
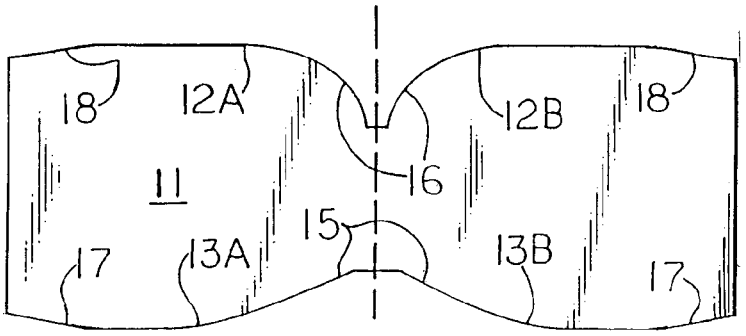

Column 2,
Line 18, delete "2" inserting therefor -- 5, --.
Line 48, insert the following sentence after "fit."
-- Accordingly, at least two of the set of tapers can be of a shape and size different from each other. --
Line 67, delete "seams." insert therefor -- seams (FIGS. 5 & 6). --.

Column 3,
Line 30, delete "ton" and insert therefor -- top --

Signed and Sealed this

Second Day of July, 2002

*Attest:*

*Attesting Officer*

JAMES E. ROGAN
*Director of the United States Patent and Trademark Office*